US005456929A

United States Patent [19]

Mifune et al.

[11] Patent Number: 5,456,929

[45] Date of Patent: Oct. 10, 1995

[54] READY-TO-HEAT CANNED GOODS

[75] Inventors: Hideo Mifune; Tomio Nitta; Tsutomu Shike, all of Shizuoka, Japan

[73] Assignee: Tokai Corporation, Japan

[21] Appl. No.: 146,155

[22] PCT Filed: Mar. 25, 1993

[86] PCT No.: PCT/JP93/00355

§ 371 Date: Nov. 12, 1993

§ 102(e) Date: Nov. 12, 1993

[87] PCT Pub. No.: WO93/19998

PCT Pub. Date: Oct. 14, 1993

[30] Foreign Application Priority Data

| | | | |
|---|---|---|---|
| Mar. 31, 1992 | [JP] | Japan | 4-077025 |
| Apr. 10, 1992 | [JP] | Japan | 4-090752 |
| Apr. 22, 1992 | [JP] | Japan | 4-103037 |
| May 15, 1992 | [JP] | Japan | 4-123732 |
| Jun. 10, 1992 | [JP] | Japan | 4-150817 |

[51] Int. Cl.[6] ..... B65D 25/08

[52] U.S. Cl. ..... 426/118; 426/77; 426/106; 426/112; 426/113; 426/119; 426/120; 426/124; 426/394; 426/407; 426/131; 206/219; 206/220

[58] Field of Search ..... 426/112, 113, 426/118, 119, 120, 124, 106, 77, 108, 394, 407, 131, 79; 206/219, 220, 222

[56] References Cited

U.S. PATENT DOCUMENTS

| | | | |
|---|---|---|---|
| 2,387,978 | 10/1945 | Casey | 426/112 X |
| 3,039,644 | 6/1962 | Lefcort | 426/120 X |
| 3,275,448 | 9/1966 | Sommer | 426/120 X |
| 3,589,272 | 6/1971 | Bouladon | 426/112 X |
| 3,743,520 | 7/1973 | Croner | 426/112 X |
| 3,997,676 | 12/1976 | Ando | 426/113 |
| 4,167,899 | 9/1979 | McCormick | 426/112 X |
| 4,333,581 | 6/1982 | Flansburg | 426/120 X |
| 4,399,158 | 8/1983 | Bardsley et al. | 426/112 |
| 4,596,713 | 6/1986 | Burdette | 426/124 X |
| 4,803,088 | 2/1989 | Yamamoto et al. | 426/113 X |
| 4,821,630 | 4/1989 | Roberts | 426/112 X |

FOREIGN PATENT DOCUMENTS

| | | |
|---|---|---|
| 2-135482 | 12/1990 | Japan . |
| 3-34421 | 4/1991 | Japan . |
| 3-136614 | 6/1991 | Japan . |

*Primary Examiner*—Donald E. Czaja
*Assistant Examiner*—Milton I. Cano
*Attorney, Agent, or Firm*—Brumbaugh, Graves, Donohue & Raymond

[57] ABSTRACT

Liquid contents such as water are stored in a heat-resisting can body having an openable section formed on an upper part thereof. Other material is stored within the can body while being separated from the liquid contents and, when the can body is heated above a predetermined temperature with the openable section opened, the separation between the stored material and the liquid is removed and the liquid can come in contact with the stored material. When the openable section is closed while the can body is heated, the stored material is kept separate from the liquid even during a sterilizing process but, when the can body is heated with the openable section opened, the separation between the stored material and the liquid is removed, and consequently the contents are mixed together. This permits the stored material to be preserved from the liquid until the contents of the can body are ready for use.

5 Claims, 15 Drawing Sheets

46
20
6c
48
45
21
47
6a
47a
47b

READY-TO-HEAT CANNED GOODS

TECHNICAL FIELD

This invention relates to canned goods to be heated wherein contents of the canned food or beverage are directly heated together with the body of the can itself when it is in use.

BACKGROUND ART

Canned goods have hitherto been used for non-perishables. When it is necessary to cook these contents by heating, the contents are cooked after a lid of the can has been opened and the contents have been poured into another vessel. Moreover, the contents of the can are mixedly contained in the can without separation.

In respect of canned beverages, some of them are dispensed by a vending machine which keeps them warm. For instance, in the case of beverages such as red tea, green tea or oolong tea, ingredients of the tea are previously leached from tea-leaves by infusing the tea-leaves in hot water. A resulting infusion is then packed into cans, and canned beverages thus produced are then distributed and sold. The canned beverages are usually kept warm inside a vending machine.

Some contents may be enhanced to a greater extent in commercial value by mixing them when heated as compared with the heating of the pre-mixed contents of the foregoing canned beverages. It is difficult for conventional canned foods or beverages to meet such a demand.

For example, in the case of canned beverages, ingredients of several types of beverages are already leached out and packed into cans. Such a beverage is slightly different from a beverage in which ingredients thereof are leached or dissolved immediately prior to being drunk. The commercial value of some beverages is enhanced by infusing tea-leaves in hot water when they are drunk. Conventional canned beverages cannot meet such a demand.

Hence, the object of this invention is to provide canned goods to be heated arranged to make it possible to store contents in isolation from each other, and also to heat the contents while they are mixed together when the canned food or beverage is used.

Another object of this invention is to provide canned goods which are subjected to a heat treatment for sterilizing purposes at a given temperature and for a given period which are suitable for the contents of a canned food or beverage after the contents have been packed, and which is arranged to make it possible to store the contents in isolation from each other after the sterilizing process, and the separated contents are mixed together when the canned food or beverage is heated.

DISCLOSURE OF THE INVENTION

To solve the foregoing drawbacks in the prior art, canned goods of this invention are basically arranged to contain liquid contents such as water within a heat-resisting can body having an opening section formed on an upper part of the can body, and to store other contents isolated from the liquid contents, and to bring both contents into contact with each other by heating the can above a predetermined temperature with the opening section open so that the separated contents can become mixed together.

With such an arrangement, when the can remains sealed and preserved before it is heated, contents stored within the heat-resisting can body are kept isolated from each other even after the sterilizing process. However, when the can body is open and heated, the contents are mixed together. Thus, it is possible to achieve the preserved state and heated state suitable for the contents, and hence it is possible to enhance the commercial value of the canned goods.

As a first specific structure for such canned goods, liquid contents such as water are contained in a heat-resisting can body having an opening section formed on an upper part thereof. A capsule body is also inserted into this can body, and this capsule body is composed of a casing containing other contents and sealed by a closing member which opens the casing when a pressure difference between inside and outside the capsule exceeds a predetermined value. When the can body is heated while open, the closing member opens the casing in accordance with the inflation of a gas inside the capsule body.

According to the first structure set forth above, the heat-resisting body contains not only liquid contents such as water but also the capsule body composed of the casing containing other contents and sealed by means of the closing member. The contents are stored in the can body while they are isolated from each other. The can body is then subjected to heating and sterilizing while sealed, and hence an internal pressure of the capsule body is increased by heating. However, the capsule body also undergoes an increased internal pressure of the can body, and is pressurized. Since a pressure difference between inside and outside the capsule is nominal, the closing member remains sealed, so that the casing is eventually kept sealed. Thus, the contents are preserved while they are isolated from each other even after the heating process.

When canned goods are in use, the internal pressure of the can body is open into the atmosphere when the temperature of the can body is increased as the can is heated while open. Hence, no pressure rise occurs in the can body. Meanwhile, the inner gas of the capsule body inflates in accordance with a temperature rise, which in turn causes the internal pressure of the capsule body to increase. When a pressure difference between inside and outside the capsule body exceeds a predetermined level; namely, the capsule body is heated to a predetermined temperature, the closing member is open. This results in the capsule body being released from its sealed state, so that the contents encapsulated in the capsule body are mixed with the liquid contents.

As a second structure the inside of a heat-resisting can body having an opening section formed on an upper part thereof is divided into an upper compartment and a lower compartment by means of a resilient membrane. Liquid contents are stored in the lower compartment, whereas other contents are stored in the upper compartment while they are isolated from each other. In addition, a needle-shaped member is positioned above the resilient membrane so that the resilient membrane which inflates when the can body is heated can rupture upon contact with the needle.

According to the second structure, the resilient membrane divides the inside of the can body into the upper and lower compartments, and liquid contents such as water and other contents are stored while they are isolated from each other. After the can body has been filled with the contents, it is subjected to heating and sterilizing while sealed. There occurs only a small pressure difference between both compartments which are separated from each other by the resilient membrane. The resulting inflation of the resilient membrane is small, and hence the membrane cannot be ruptured by the needle-shaped member. Thus, the contents are preserved while the compartments are kept intact after heating. When canned goods are in use, they are heated with their opening section open. At this time, the lower compartment is sealed, whereas the upper compartment is kept open. The resilient membrane inflates in accordance with a temperature rise, and eventually comes into contact with the needle-shaped member to be ruptured. The contents stored in the upper compartment drop into the liquid contents, and they are mixed together. Thus, the cooking or preparation of the contents is carried out.

If the upper compartment is filled with a carbon dioxide gas or a nitrogen gas so that it can be pressurized, the degree of inflation of the resilient membrane occurring during the heating and sterilizing processes will be reduced, and hence it becomes possible to effect the sterilizing process at a higher temperature. On the other hand, if the liquid contents stored in the lower compartment are mixed with a carbon dioxide gas and alcohol or the like, a processing temperature of the sterilizing process will be decreased, and also the degree of inflation of the resilient membrane will be reduced. Thereby, it is possible to maintain the compartments separated by the membrane with a greater certainty after the sterilizing process.

As a third structure, liquid contents such as water are stored in a heat-resisting can body having an opening section formed on an upper part thereof. A bag-shaped member made of a resilient material which hermetically contains other contents and a predetermined amount of gas is also inserted in the can body. Moreover, an opening means is disposed inside the can body. This opening means comes into contact with the bag-shaped member which inflates in accordance with the expansion of an inner gas of the member when the can body is heated while open, whereby the bag-shaped member ruptures.

According to the third structure, the liquid contents are stored in the heat-resisting can body, and the bag-shaped member which hermetically contains other contents and a predetermined amount of gas is inserted into the can body. Thus, the contents are stored in the can while they are isolated from each other. After the can body has been filled with the contents, it is subjected to heating and sterilizing while sealed. The gas of the bag-shaped member tends to inflate by heating, but the bag-shaped member undergoes an increased internal pressure of the can body, and is then pressurized. This entails a small amount of increase in the volume of the bag-shaped member, and hence the bag-shaped member will not be ruptured by the opening means. Thus, the bag-shaped member is kept in a sealed state, so that the bag-shaped member is preserved while the contents are isolated from each other after heating. When canned goods are in use, they are heated while open. Since the internal pressure of the can body is open into the atmosphere, it will not rise when the temperature of the can body is increased. To the contrary, an inner gas of the bag-shaped member inflates in accordance with a temperature rise, and hence the volume of the bag-shaped member is increased. This causes the bag-shaped member made of a resilient material to inflate, so that the inflated bag-shaped member comes into contact with the opening means and is ruptured. As a result of this, the contents of the bag-shaped member are mixed with the liquid contents.

As a fourth structure, liquid contents such as water are contained in a heat-resisting can body, and a bag-shaped member which hermetically contains other contents and a predetermined amount of gas is also inserted into the can body. The bag-shaped member is provided with a sealed section which opens when the bag-shaped member inflates in accordance with the inflation of an inner gas of the bag-shaped member by heating the can body while open.

According to the fourth structure, the liquid contents such as water are stored in the heat-resisting can body, and the bag-shaped member which hermetically contains other contents and a predetermined amount of gas is also inserted into the can body. The contents are contained in the can body while being isolated from each other. After the can body has been filled with the contents, it is subjected to heating and sterilizing while sealed. This heating involves the inflation of the gas of the bag-shaped member, but this bag-shaped member experiences an increased internal pressure of the can body, and hence it is pressurized. This brings about a small amount of increase in the volume of the bag-shaped member. The bag-shaped member is kept intact in a sealed state. Thus, the contents are preserved while still isolated from each other after heating. When canned goods are in use, they are heated while open. The internal pressure of the can body is open into the atmosphere, and hence it will not rise when the temperature of the can body is increased. To the contrary, the inner gas of the bag-shaped member Inflates in accordance with a temperature rise, which in turn entails the volume of the bag-shaped member to be increased. This cause the bag-shaped member having the sealed section to inflate, so that the sealed section opens. As a result of this, the contents of the bag-shaped member are mixed with the liquid contents.

As a fifth structure, the inside of a heat-resisting can body is divided by means of a separating member. This separating member is insoluble in water at a normal temperature or infusible at a temperature below its melting point, but it is dissolved when heated above a predetermined temperature or fused when the temperature exceeds the melting point. With such a structure, liquid contents containing water as a principal component and other contents are stored in the can body while being isolated from each other.

According to the fifth structure, the inside of the heat-resisting can body is divided by means of the separating member which is insoluble or infusible at a normal temperature. The liquid contents containing water as the principal component and the other contents are stored in the can body while being isolated from each other. When canned goods are in use, they are directly heated. The separating member is dissolved or fused when heated above a predetermined temperature. The contents are heated while being mixed together, and then cooked. When the can is subjected to heating and sterilizing, it undergoes a treatment at a temperature below the foregoing predetermined temperature.

As a sixth structure, liquids such as water are sealed within a heat-resisting can body having an outlet port formed on an upper part thereof. A compartment for storing contents such as tea-leaves is connected to the outlet port, and a valve mechanism is provided on the end of the compartment located furthermost from the outlet port. The valve mechanism is kept sealed at a normal temperature, but is open when the can body is heated above a predetermined temperature.

According to a sixth embodiment, the valve mechanism remains sealed at a normal temperature, and hence the contained liquids will not enter the compartment. Thus, the liquids and the contents such as tea-leaves in the compartment are preserved while being isolated from each other. When canned goods are in use, the can body is directly heated. When the can body is heated above a predetermined temperature, the valve mechanism opens, which in turn allows the liquids to enter the compartment. As a result of this, tea-leaves of red tea, green tea or oolong tea are infused in boiling water, whereupon ingredients are leached out of the tea-leaves. An infusion thus produced is then poured from the outlet port as a drink. When the can body is subjected to heating and sterilizing, the processes are carried out at a temperature lower than the predetermined temperature.

BEST MODE FOR PRACTICING THE INVENTION

With reference to the drawings, embodiments of this invention will now be described hereinbelow.

<First Embodiment>

Figure 1:
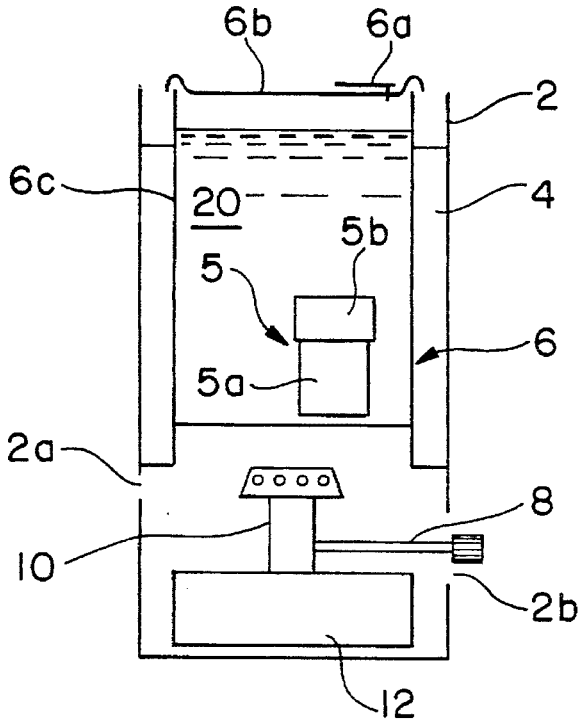
FIG. 1 is a schematic cross-sectional view showing a canned food or beverage having a burner which uses canned goods to be heated according to a first embodiment of this invention.
Figure 2:
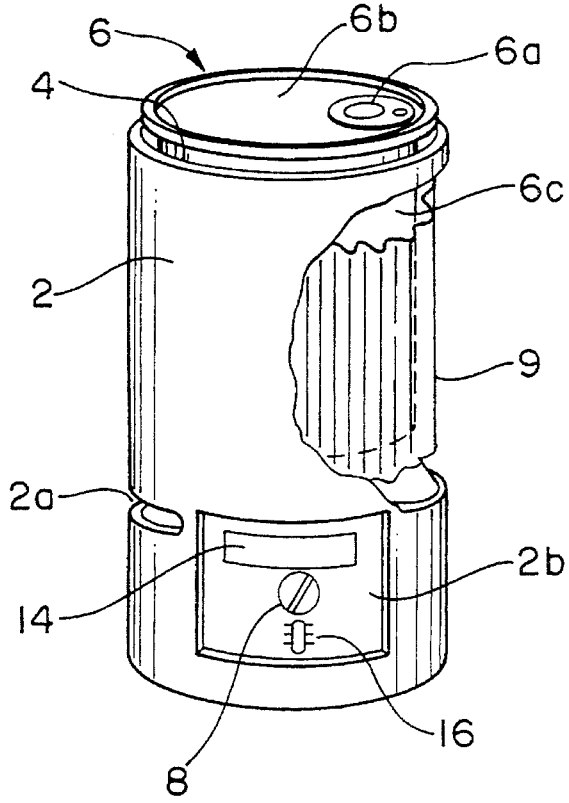
FIG. 2 is a partially cut away perspective view showing one example of the appearance of the canned food or beverage shown in FIG. 1.

FIG. 1 is a cross-sectional view showing the principal structure of a canned food or beverage having a burner which uses canned goods to be heated according to this embodiment; and FIG. 2 is a partially cut away view showing one example of the appearance of the can shown in FIG. 1.

A canned product basically comprises a cylindrical outer case 2 with at least the upper end thereof open; a can to be heated 6 made of a cylindrical heat-resisting can body 6*c*, and fixedly housed in the outer case 2 with a gap 4 therebetween for the rise of combustion gases, and also having an opening section 6*a* (an opening tab) on the upper end surface thereof; a burner 10 equipped with an ignition means 8 and fixedly housed inside and below the outer case 2 for heating the can 6; and a fuel tank 12 fixed inside and below the outer case 2 for supplying fuel to the burner 10. The outer case 2 is provided with an air-intake port 2*a* for supplying air from the outside to the burner 10 and an opening 2*b* for operation of the ignition means 8 from the outside.

The opening 2*b* used for operating the ignition means 8 from the outside is further provided with a window 14 through which flames of the burner 10 can be checked from the outside and a scaled window 16 by which the quantity of fuel remaining in the fuel tank 12 can be checked (see FIG. 2).

Figure 4:
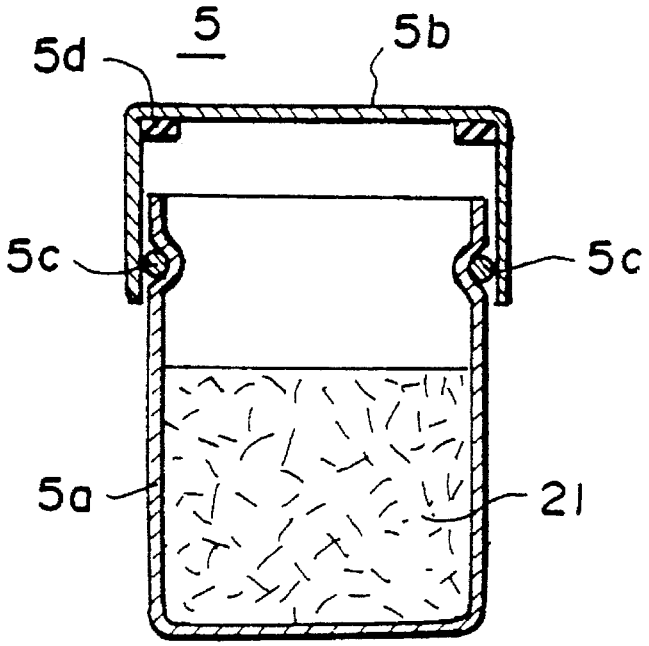
FIG. 4 is a cross-sectional view showing a capsule body shown in FIG. 1.

In the can 6, the heat-resisting can body 6*c* contains liquid contents 20 (for example, water or liquids for drink or the like) and a capsule body 5. The capsule body 5 also hermetically contains powdered or solid contents 21 (for example, instant coffee, soup stock, a tea bag, tea leaves, and noodles or the like) as shown in FIG. 4.

In the capsule body 5, a closing member 5*b* made of a cylindrical cap is slidably, in a sealed manner, fitted around the outer periphery of the opening of a cylindrical case 5*a* which constitues a compartment for storing the contents 21. The contents 21 and a predetermined amount of gas (air or the like) are hermetically contained in the capsule body 5. This closing member 5*b* is designed so that it can open by means of the inflation of the gas encapsulated in the capsule when a pressure difference between outside and inside the capsule exceeds a predetermined level.

In effect, a sealing member 5*c* (for example, an O-ring) is interposed between the case 5*a* and the closure 5*b* in order to assure an airtightness between them. The strength and amount of the fitting determine an opening temperature of the closing member. In other words, the length of the fitting of the closing member 5*b* in the capsule 5 is set to a length which permits the closing member 5*b* to be slidably disengaged from the case 5*a* by the inflation of air inside the capsule body 5 when the capsule body 5 is heated to a predetermined temperature (for example, 90 degrees Centigrade) under the substantial atmospheric pressure. Moreover, ring-shaped rubber packing 5d is disposed on the bottom of the closure 5b with which the end of the case 5a can come into contact.

Figure 3:
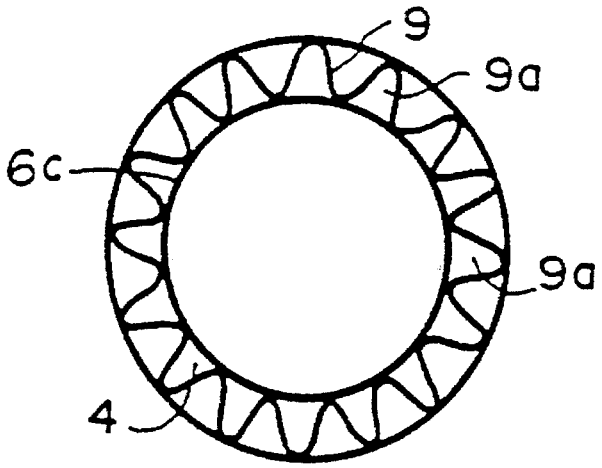
FIG. 3 is a horizontal schematic cross-sectional view showing an example of the structure between an outer case and a can body of the canned food or beverage having a burner shown in FIG. 1.

The gap 4 through which combustion gases rise is formed between the exterior surrounding surface of the outer case 2 and the can body 6c of the can 6. There are provided a structure for constituting this gap 4 and a means for fixing the outer case 2 and the can body 6c. Practically, as can be seen from the horizontal cross sectional view of FIG. 3, a crimped partition plate 9 which longitudinally extends is sandwiched between the outer case 2 and the can body 6c. As is shown in FIGS. 1 and 2, this crimped patition plate 9 extends downwards past the lowermost end of the can body 6c. In this case, the partition plate 9 acts to fix both the outer case and the can body, and spacing 9a formed inside the crimps of the partition plate 9 serve as the gap 4 through which combusion gases rise. The partition plate 9 may be formed in a crimped shape, as shown in the drawing, including warped surfaces, or may be in a triangular shape containing angled planar surfaces.

A piezo-electric type automatic ignition unit is employed as the ignition means 8 of the burner since it is desirable in practical use because of its convenience. Also, in view of safety, it is desirable for the burner 10 to be provided with a safety device which automatically interrupts the supply of fuel to the burner 10 when flames go out.

Figures 5A, 5B, 5C, 5D:
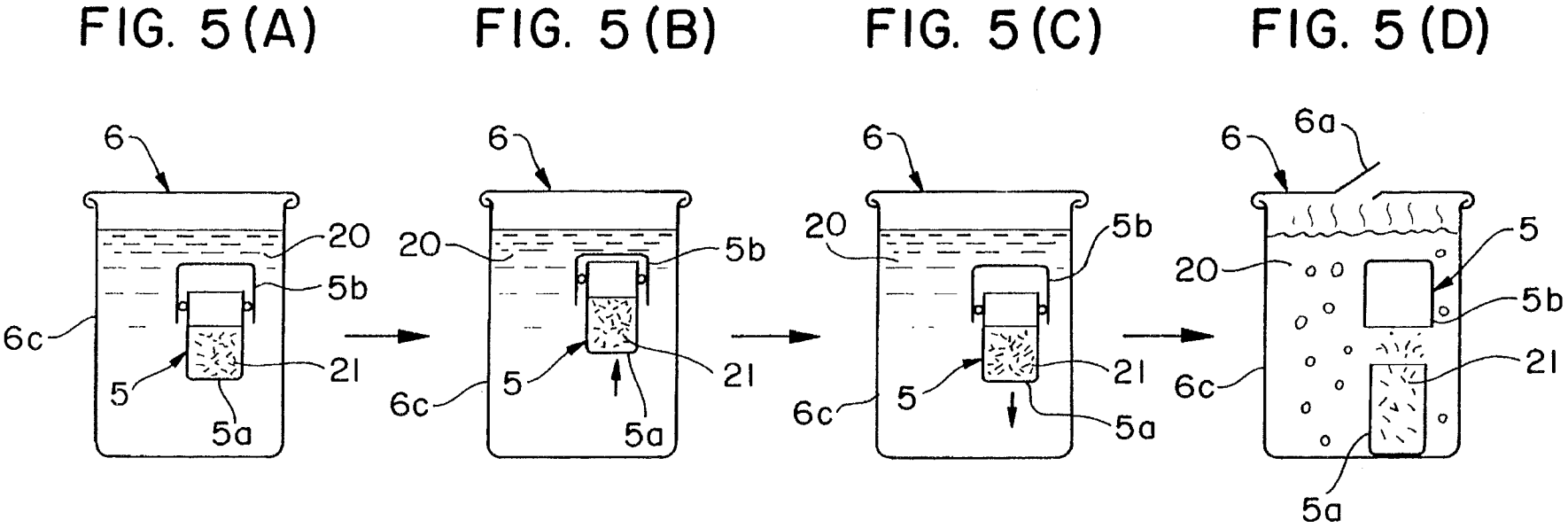
FIGS. 5(A)–5(D) are explanatory diagrams showing operating states of the canned food or beverage shown in FIG. 1 in a successive order.
Figure 6:
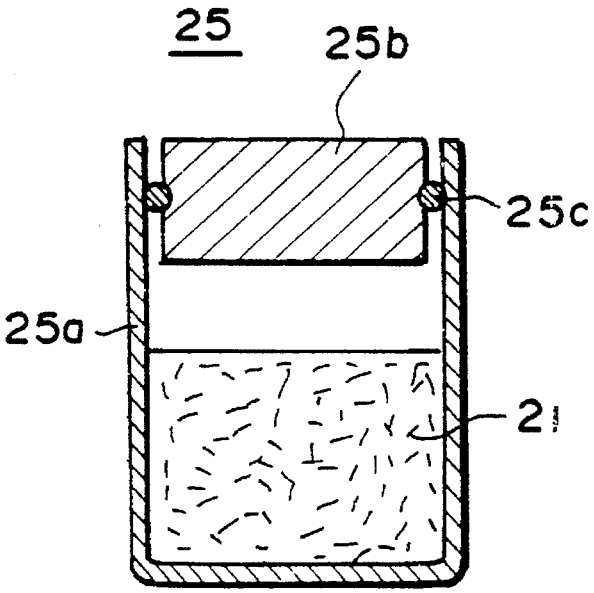
FIGS. 6 through 9 are cross-sectional views, each showing a modified example of the capsule body according to the embodiment shown in FIG. 1.

The operation of this embodiment will now be described. In the can 6 immediately after liquid contents 20 and the capsule body 5 are sealed within the can, the internal pressure of the can body 6c and the capsule body 5 is about 1 atm. as shown in FIG. 5(A). The closing member 5b of the capsule body 5 is in an initially sealed state, and the liquid contents 20 and the solid contents 21 are isolated from each other.

FIG. 5(B) shows that the can body is heated during a sterilizing process, and the can body 6c of the can 6 remains sealed. In accordance with a rise in temperature, the internal pressure of the can body 6c rises to, for example, about 2.7 atm. at a sterilizing temperature of 110 degrees Centigrade because of the inflation of the inner gas of the can body and a rise in a vapor pressure. Likewise, a rise in temperature causes an inner gas of the capsule body 5 to inflate, but the capsule body 5 undergoes the internal pressure of the can body 6c, whereupon the closing member 5b slidably contracts so that the volume of the capsule body can be reduced. At this time, the internal pressure of the capsule body 5 is about 1.3 atm. A heating temperature in the foregoing sterilizing process differs for the contents 20 and 21. When a heating temperature is high, the magnitude of the contraction of the closing member 5b becomes large, and also the opening end of the capsule body is forced to come into contact with the rubber packing 5d.

FIG. 5(C) shows a preserved state of the can body in which the can body is cooled to a normal temperature after it has been heated in the sterilizing process. This state is similar to that shown in FIG. 5(A), wherein the closing member 5b of the capsule body 5 inflates in response to a drop in the internal pressure of the can body 6c due to a drop in temperature. Thus, the capsule body 5 is kept sealed, and the internal pressure of the capsule body and the can body is reduced to about 1 atm. in a normal temperature state, so that both contents 20 and 21 are preserved while they are isolated from each other.

When the can 6 is in use as shown in FIG. 5(D), the can body 6c is open by operating the opening section 6a prior to heating, so that the upper space of the can is open to the atmosphere. The burner 10 is ignited, and the bottom of the can body 6c is directly subjected to flames, and heated. The lower end of the partition plate 9 extends downwards past the lowermost end of the can body 6c, and hence heated gases produced by flames of the burner 10 only rise through the inner spacing 9a which faces a surrounding wall of the can body 6c located inside the partition plate 9 (see FIG. 3). Thus, the can 6 is efficiently heated, and a rise in the temperature of the outer case 2 is suppressed.

When the temperature of the liquid contents 20 is increased by heating by means of the burner 10, the temperature of the capsule body 5 is also increased, and a gas hermetically contained in the capsule body 5 increases in volume due to heat. The internal pressure of the capsule body rises to about 1.3 atm. at a temperature of 90 degrees Centigrade. However, the capsule body does not experience the increased internal pressure of the can body 6c when compared with the sterilizing process, and hence the closing member 5b of the capsule body 5 slidably inflates in accordance with a rise in the internal pressure of the capsule body. When the liquid contents are heated to about 90 degrees Centigrade, the closing member 5b is removed from the case 5a, so that the contents 21 are released from their sealed state. Eventually, the liquid contents 20 enter the case 5a and both contents are mixed together.

FIGS. 6 through 9 show modified examples of the capsule body according to this embodiment. In the case of a capsule body 25 shown in FIG. 6, a case 25a for containing the contents 21 is in a cylindrical shape, and a sealing member 25c (for example, an O-ring) is sandwiched between the inner periphery of the opening of the case and a closing member 25b made of a disk-shaped closure. The closing member is slidably fitted into the case while airtightness is assured, and the contents 21 and a predetermined amount of gas (air or the like) are hermetically contained in the capsule body. The closing member 25b. is set in such a manner that the closing member can slidably open depending on the strength and amount of its fitting by the inflation of the gas hermetically contained in the capsule when the liquid contents are heated above a predetermined temperature and when a pressure difference between the inside and outside the capsule exceeds a predetermined level.

Figure 7:
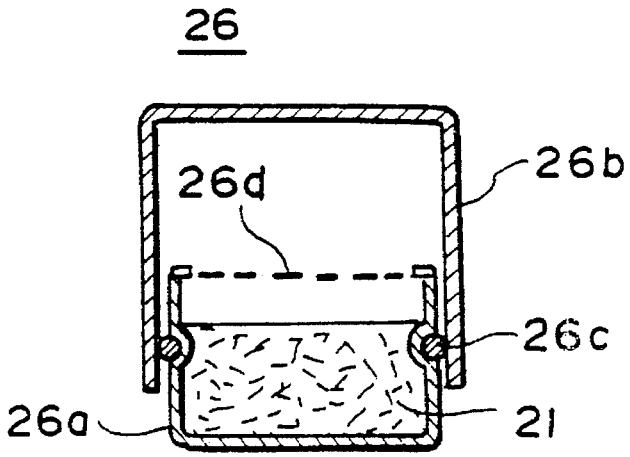

In the case of a capsule body 26 shown in FIG. 7, a case 26a for containing the contents 21 is cylindrical in shape, and a meshed member 26d is disposed on the opening section of the capsule body in order to prevent the contents 21 from being diffused outsides. Hence, the case is suitable for the storage of tea leaves or the like. A cap-shaped cylindrical closing member 26b is fitted around the case 26a via a sealing member 26c. The contents 21 and a predetermined amount of gas (air or the like) are hermetically contained in the case while air-tightness is assured. The closing member 26b is set in such a manner that the closing member can slidably open depending on the strength and amount of its fitting by the inflation of the gas hermetically contained in the capsule when the liquid contents are heated above a predetermined temperature and when a pressure difference between the inside and outside the capsule exceeds a predetermined level.

Both the case 26a and the closing member 26b, shown in FIG. 7, are formed into a case, and they slidably move relative to each other. Any one of them may be called a case. Also, the contents 21 may be arranged on the bottom of the closing member 26b by covering them with a meshed member.

Figure 8:
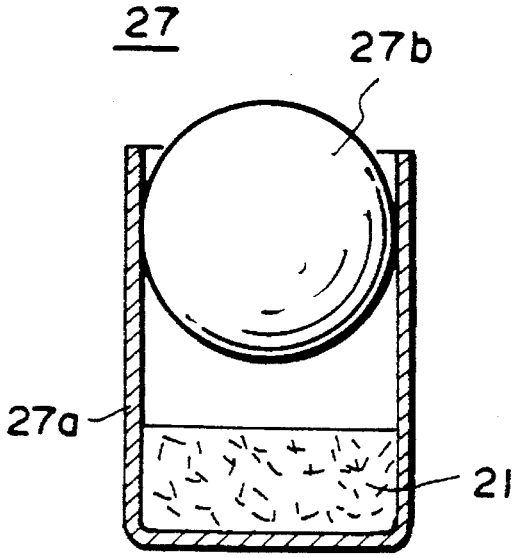

In the case of a capsule body 27 shown in FIG. 8, a case 27a for containing the contents 21 is cylindrical in shape, and a ball-shaped sealing member 27b made of a resilient member such as rubber is fitted along the inner periphery of the opening of the case while an airtightness is assured. The contents 21 and a predetermined amount of gas (air or the like) are hermetically contained in the capsule body. The closing member 27*b* is set in such a manner that the closing member can slidably open depending on the strength and amount of its fitting by the inflation of the gas hermetically contained in the capsule when the liquid contents are heated above a predetermined temperature and when a pressure difference between the inside and outside the capsule exceeds a predetermined level.

Figure 9:
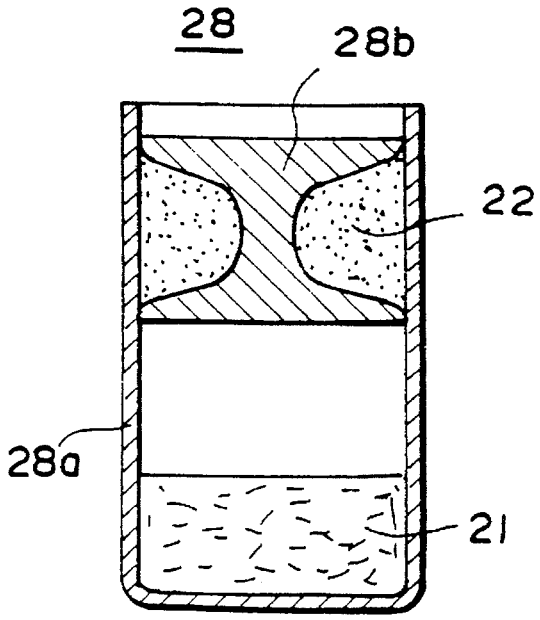

In the case of a capsule body 28 shown in FIG. 9, a case 28*a* for containing the contents 21 is in a cylindrical shape, and a closure-shaped closing member 28*b* made of a resilient member such as rubber is fitted along the inner periphery of the opening of the case while airtightness is assured. A recess is formed in the middle of this closing member 28*b*, and other contents 22 are stored in the spacing between the recess and the inner periphery of the case while the contents are isolated from each other. The upper and lower edges of the closing member come into contact with the inner surface of the case 28*a*, and hence airtightness is assured. Two types of contents 21 and 22 and a predetermined amount of gas (air or the like) are hermetically contained in the case. The closing member 28*b* is set in such a manner that the closing member can slidably open depending on the strength and amount of its fitting by the inflation of the gas hermetically contained in the capsule when the liquid contents are heated above a predetermined temperature and when a pressure difference between the inside and outside the capsule exceeds a predetermined level.

The shape and dimensions of each of the above-mentioned capsules may be appropriately changed in response to the quantity and shape of the contents 21.

FIGS. 10 through 13 show examples of the storage of the capsule body in the can body 6*c* according to this embodiment. A meshed member is disposed to prevent the contents 21 (chiefly tea leaves) stored in the capsule body from being diffused or discharged outside.

Figure 10:
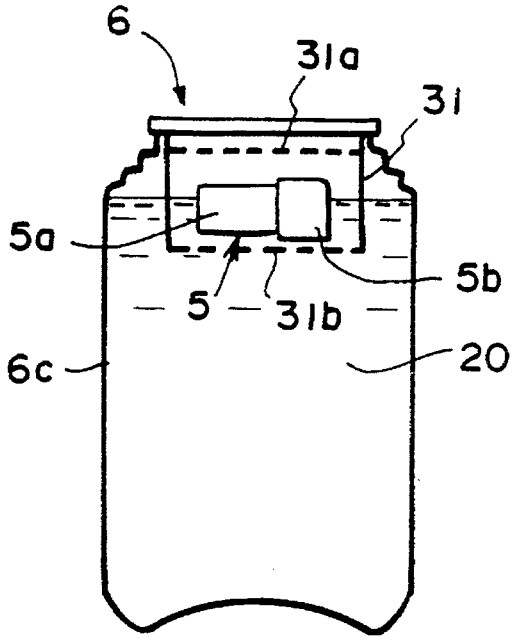
FIGS. 10 through 13 are explanatory diagrams, each showing an example of the storage of the capsule in the can body.

In an example shown in FIG. 10, a retaining member 31 for holding the capsule body 5 (it may be another capsule other than the example shown in FIG. 7) is arranged on an upper part of the can body 6*c*. Upper and lower surfaces of this retaining member 31 are made of meshed members 31*a* and 31*b*. When the can body 6*c* is opened and heated, the closing member 5*b* of the capsule body 5 is open because of a rise in temperature. As a result of this, the liquid contents 20 enter the capsule body 5, whereupon the contents 21 such as tea leaves are discharged from the capsule, and tend to spread over the entire liquid contents 20. However, the presence of the lower meshed member 31*b* obstructs the contents from being diffused, whereas the presence of the upper meshed member 31*a* hinders the contents 21 such as tea leaves from flowing out when the liquid contents 20 are poured out of the can body 6*c*.

Figure 11:
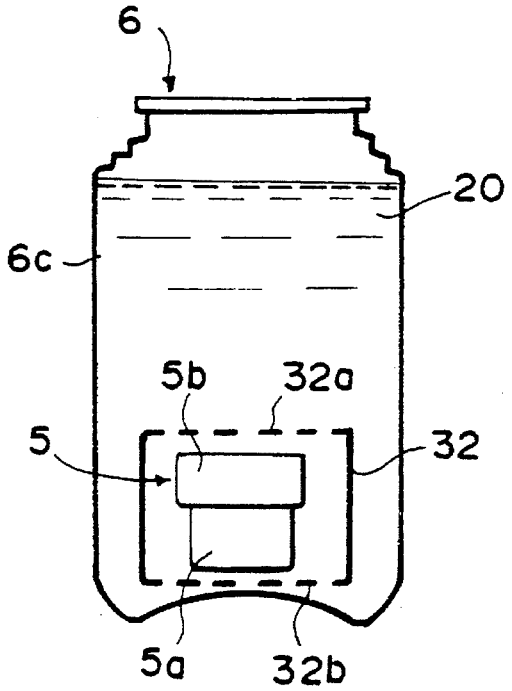

In an example shown in FIG. 11, a retaining member 32 for holding the capsule body 5 (it may be another capsule other than the example shown in FIG. 7) is arranged on the bottom of the can body 6*c*. Upper and lower surfaces of this retaining member 32 are made of meshed members 32*a* and 32*b*. These meshed members act in the same manner as those shown in FIG. 10.

Figure 12:
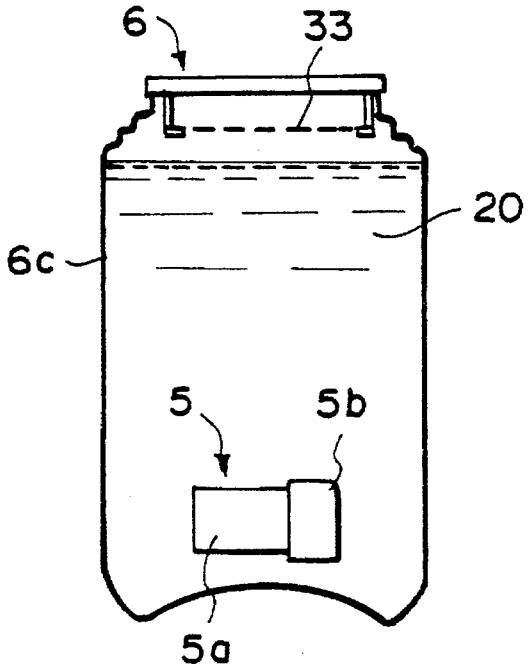

In an example shown in FIG. 12, the capsule body 5 (it may be any other capsule other than the example shown in FIG. 7) is stored while it stands at it is in the liquid contents 20. A meshed member 33 covers an upper part of the opening section of the capsule body 6*c*. When the capsule body 5 is open, the contents 21 such as tea leaves are discharged from the capsule, and spread over the entire liquid contents 20. The presence of the meshed member 33 prevents the contents 21 such as tea leaves from flowing out when the liquid contents 20 are poured out of the can body 6*c*.

Figure 13:
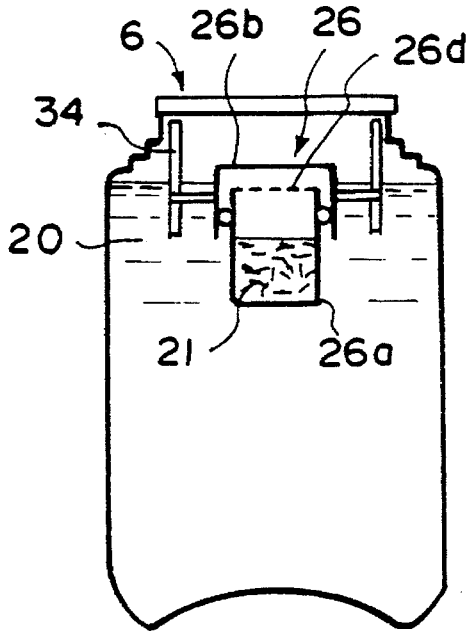

In an example shown in FIG. 13, a capsule body 26 having a meshed member 26*d* disposed therein, as shown in FIG. 7, is stored. A holder 34 for holding a closing member 26*b* of the capsule body 26 is provided on an upper part of the can body 6*c*. When the liquid contents are heated, the capsule body 26 is open, whereupon a case 26*a* falls. The liquid contents 20 eventually enter the case 26*a*, but the presence of a meshed member 26*d* hinders the contents 21 of the case 26*a* from being diffused.

The case of the capsule body and the closing member in this embodiment are formed from metal such as aluminum, or the like, or heat-resisting plastics. A difference in thermal conductivity between materials leads to different opening timing.

Practically, when an opening temperature is set the same, if the capsule body is made of metal such as aluminum, the internal pressure of the capsule body immediately rises in association with a rise in temperature of the liquid contents because of a high thermal conductivity of the capsule. The closing member is open slightly after the temperature of the liquid contents has reached a predetermined level. For instance, the capsule is released from its scaled state before the liquid contents reach a boiling point. On the other hand, in the case of the capsule made of plastics having a low thermal conductivity, the temperature of an inner gas rises after the temperature of the liquid contents has risen. Even when the liquid contents reach a preset temperature, the capsule opens after a considerable time lag has elapsed. For instance, the capsule may have a characteristic in which the capsule opens after the liquid contents have boiled. On the basis of such a characteristic, the material of the capsule is selected in accordance with types of contents, and hence it becomes possible to obtain a desired opening characteristic.

The capsule may be applied to, for instance, beverages such as coffee, tea and milk or foods such as noodles like a cup noodle, miso soup and soup by varying the size and material of the capsule body according to this embodiment.

<Second Embodiment>

Figure 14:
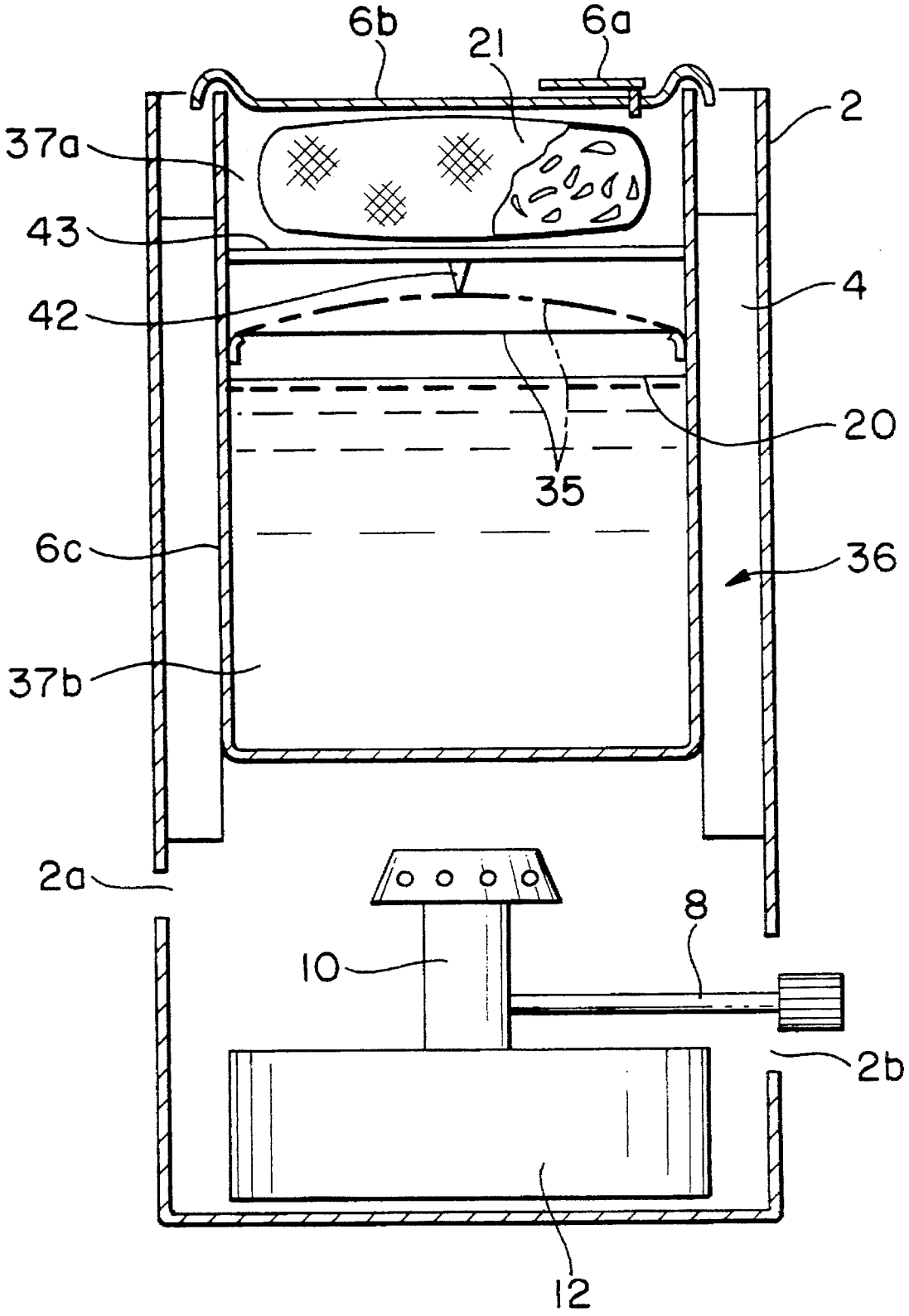
FIG. 14 is a schematic cross-sectional view showing a canned food or beverage having a burner which uses canned goods to be heated according to a second embodiment of this invention.

FIG. 14 is a schematic cross-sectional view showing a canned food or beverage having a burner which uses canned goods of this embodiment.

The principal structure of a canned food or beverage having a burner is the same as the above embodiment. The can is provided with a cylindrical outer case 2, a can to be heated 36 fixedly housed at an upper part within this outer case 2; a burner 10 having an ignition means 8; and a fuel tank 12. The same reference numerals are provided to designate the corresponding features in the first embodiment.

In a can to be heated 36, a membrane-shaped resilient film 35 possessing a rubber elasticity is fixed to the inner peripheral surface of the heat-resisting can body 6*c*, so that the inside of the can body 6*c* is divided into upper and lower compartments 37*a* and 37*b*. Liquid contents 20 (for example, water and liquids for drink or the like) are hermetically sealed within the lower compartment 37*b*, whereas solid contents 21 (for example, instant coffee, soup stock, a tea bag, tea leaves and noodles or the like) are hermetically sealed within the upper compartment 37*a*.

If necessary, carbon dioxide gas or nitrogen gas is sealed within the upper compartment 37*a*, and the pressure of the upper compartment 37*a* is pressurized so that it can be larger than the pressure of the lower compartment 37*b*, or a carbon dioxide gas or alcohol are mixed into the liquid contents in the lower compartment 37*b*. When carbon dioxide gas or nitrogen gas is sealed within the lower compartment 37*b*, a carbon dioxide gas or a nitrogen gas may be sealed within the upper compartment 37*a* at a different pressure so that the pressure of the upper compartment can be larger than that of the lower compartment.

A needle-shaped member 42 with a sharp end facing downwards is arranged above the resilient membrane 35 with a predetermined gap therebetween. With regard to this needle-shaped member 42, a rod-shaped supporting section 43 is disposed along the diameter of the can body 6*c*. The shape and mounting structure of this member 42 can be appropriately changed. The contents 21 are in fact accommodated in the upper compartment 37 while they are arranged to avoid the vicinity of the needle-shaped member 42.

The sharp point of the needle-shaped member 42 is situated at a position where the resilient membrane 35 inflates upwardly as designated by a dotted line, and is ruptured upon contact with the needle-shaped member in accordance with a rise in the pressure of the lower compartment 37*b* when the can 36 is heated by means of the burner 10 while the opening section 6*a* and the upper compartment 37*a* are open to the atmosphere, and when the temperature of the liquid contents 20 rises above a predetermined temperature (for example, 90 degrees Centigrade).

The operation of this embodiment will now be described. The liquid contents 20 and the solid contents 21 are separately stored in the compartments 37*a* and 37*b* which are isolated from each other by the resilient membrane 35 immediately after the contents 20 and 21 have been sealed within the can 36. If necessary, a carbon dioxide gas or a nitrogen gas is sealed within the upper compartment 37*a* or within both compartments 37*a* and 37*b* under different pressure. Alternatively, a carbon dioxide gas or alcohol or the like is sealed in the liquid contents 20 in the lower compartment 37*b*.

In heating the can during a sterilizing process, the can 36 is sealed, and both upper and lower compartments 37*a* and 37*b* are hermetically sealed. A pressure difference between the upper and lower compartments 37*a* and 37*b* becomes smaller in accordance with a rise in temperature. The deformation of the resilient membrane 35 is also too small to be ruptured upon contact with the needle-shaped member 42, and hence the separate compartments are still maintained intact after heating.

Particularly, given that the inner pressure of the upper compartment 37*a* filled with a carbon dioxide gas is kept high, when the temperature of the sterilizing process is high, and when the pressure of the lower compartment 37*b* is increased by a rise in the partial pressure of the liquid contents 20, the degree of upward deformation of the resilient membrane 35 is reduced by the pressurization, whereby the membrane can be prevented from being ruptured, and also the compartments can be securely maintained intact during a sterilizing process at a higher temperature. It is possible to reduce a heating temperature required in the sterilizing process which must be carried out corresponding to contents by mixing a carbon dioxide gas or alcohol into the liquid contents 20 in the lower compartment 37*b*. The degree of upward deformation of the resilient membrane 35 is reduced in accordance with a drop in this sterilizing temperature. When the internal pressure of the lower compartment 37*b* is increased by filling the lower compartment with a carbon dioxide gas, it can be ensured to a greater extent that the rupture of the resilient membrane 35 in the sterilizing process is prevented by the filling of the upper compartment 37*a* with a carbon dioxide gas under pressure which is higher than the lower compartment together with a drop in the sterilizing temperature.

Meanwhile, when the can 36 is in use, it is opened by operating the opening section 6*a* prior to being heated. Thereby, the lower compartment 37*b* below the resilient membrane 35 is kept sealed, whilst the upper compartment 37*a* is open to the atmosphere. The burner 10 is ignited, and the bottom of the can body 6*c* is directly heated by flames discharged from the burner. When the temperature of the liquid contents 20 rises by heating by means of the burner 10, the resilient membrane 35 inflates upwardly due to a rise in the pressure of the sealed lower compartment 37*b*. When the membrane inflates further, the inflated resilient membrane 35 is ruptured upon contact with the needle-shaped member 42. This causes the separation between the contents 20 and 21 to be eliminated, and hence the contents 21 stored in the upper compartment 37*a* fall into the liquid contents 20, so that the contents are mixed together and cooked.

<Third Embodiment>

Figure 15:
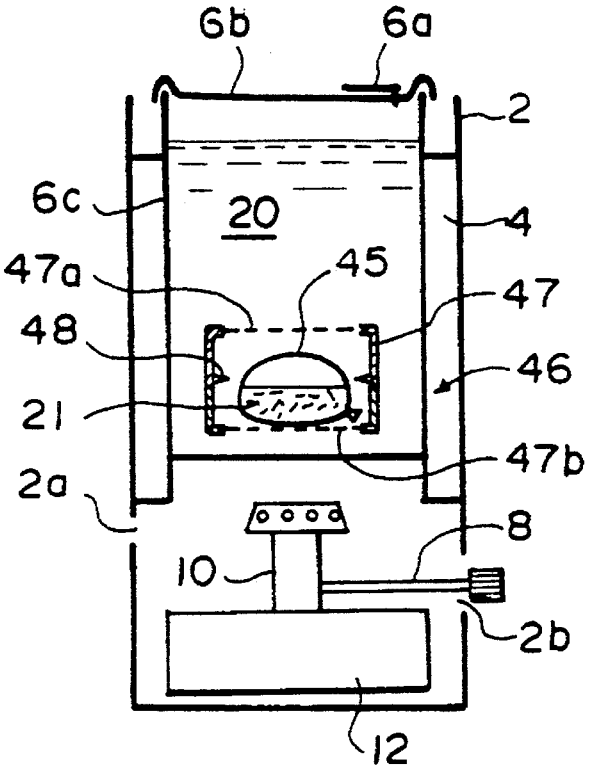
FIG. 15 is a schematic cross-sectional view showing a canned food or beverage having a burner which uses canned goods to be heated according to a third embodiment of this invention.

FIG. 15 is a schematic cross-sectional view showing a canned food or beverage with a burner which uses canned goods to be heated according to this embodiment.

The principal structure of this can is the same as the first embodiment, and the can is provided with the cylindrical outer case 2, a can to be heated 46 fixedly housed at an upper part within the outer case 2, the burner 10 with the ignition means 8 and the fuel tank 12.

Figure 16:
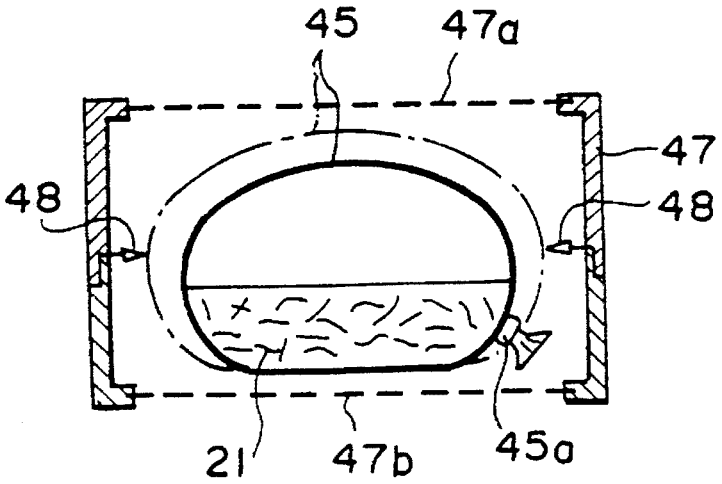
FIG. 16 is a cross-sectional view showing a bag-shaped member shown in FIG. 15.

In the can 46, the liquid contents 20 (for example, water and liquids for drink or the like) and a bag-shaped member 45 are incorporated into the can body 6*c*. As shown in FIG. 16, powder-like or solid contents 21 (for instance, instant coffee, soup stock, a tea bag, tea leaves and noodles or the like) and a predetermined amount of gas (air or the like) are hermetically contained in the bag-shaped member 45.

The bag-shaped member 45 is made of a resilient material such as rubber and formed into a bag which can be sealed. A predetermined amount of the contents 21 and gas are sealed in that member. The opening portion of the bag-shaped member is sealed with a binding tool 45*a*. The bag-shaped member 45 is housed in a retaining member 47. The upper and lower surfaces of this retaining member 47 are made of meshed members 47*a* and 47*b*, and the retaining member is constructed so that the liquid contents 20 can flow through the inside thereof. Needle-shaped opening means 48 having a sharp end are provided on the inner side surface of the retaining member so that the opening means can rupture the bag-shaped member 45 upon contact with it when the bag-shaped member is inflated to a predetermined size as designated by a dotted line.

That is to say, the temperature at which the bag-shaped member is ruptured is set by the combination of the degree of inflation of the bag-shaped member 45, which depends on the quantity of gas sealed within it and the elasticity of the resilient member, with the location of the opening means 48. In other words, when the can is heated to a predetermined temperature (for instance, 90 degrees Centigrade), the bag-shaped member 45 is set so that it can rupture upon contact with the opening means 48 when the bag-shaped member is inflated. The shape and attachment structure of the opening means 48 can be appropriately changed.

Figures 17A, 17B, 17C, 17D:
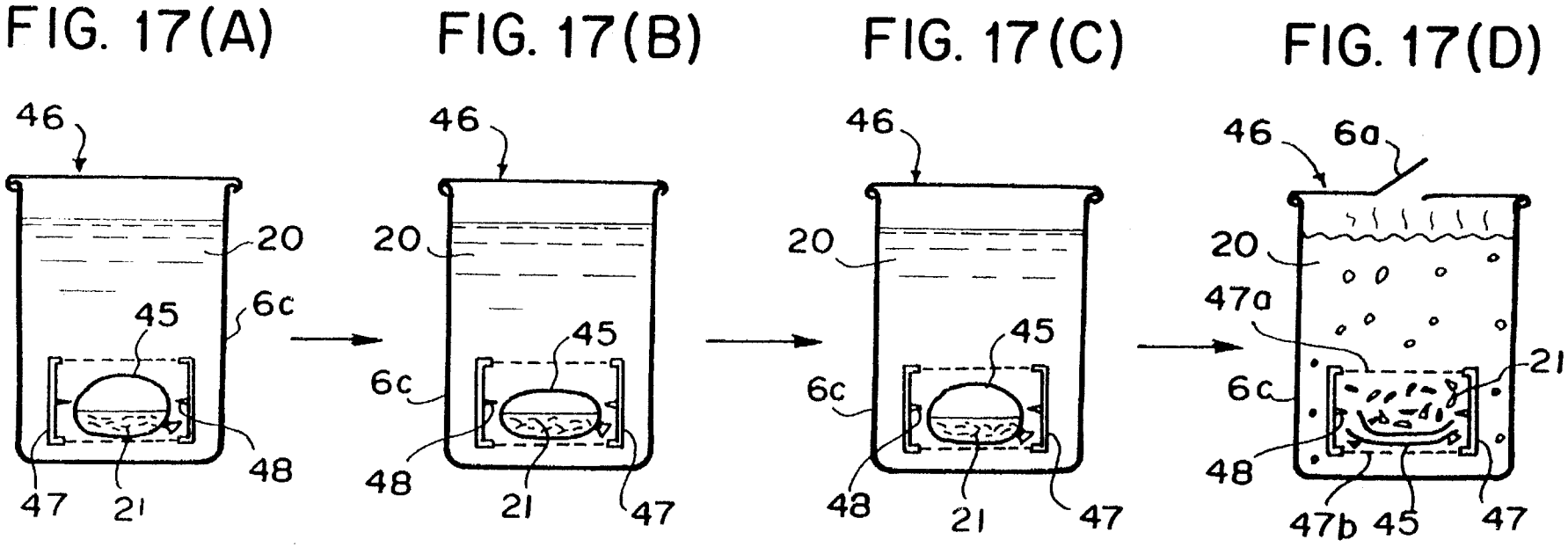
FIGS. 17(A)–17(D) are explanatory views showing operating states of the canned food or beverage shown in FIG. 15 in a successive order.

The operation of this embodiment will now be described. The internal pressure of the can body 6*c* and the bag-shaped member 45 is about 1 atm. immediately after the liquid contents 20 and the bag-shaped member 45 have been sealed within the can 46, as shown in FIG. 17(A). The content volume of the bag-shaped member 45 remains in an initial state, and the liquid contents 20 and the solid contents 21 are separated from each other.

FIG. 17(B) shows a heating state of the can in a sterilizing process. The can body 6*c* of the can 46 remains in a sealed state, and the internal pressure of the can body 6*c* rises to about 2.7 atm. at a sterilizing temperature of, for example, 110 degrees Centigrade by the inflation of the internal gas and a rise in vapor pressure in accordance with a rise in temperature. Likewise, the internal gas of the bag-shaped member 45 inflates by the temperature rise, but the bag-shaped member 45 is deformed upon receipt of the internal pressure of the can body 6*c* so that the content volume thereof can be inversely reduced. At this time, the internal pressure of the bag-shaped member 45 is about 1.3 atm. The heating temperature of the can in the sterilizing process differs from the contents 20 and 21. The amount of deformation of the bag-shaped member 45 is different in response to this heating temperature.

FIG. 17(C) illustrates a preserved state of the can when the can is cooled after having been heated in the sterilizing process. This state is the same as that shown in FIG. 17(A). The bag-shaped member 45 inflates in accordance with a drop in the internal pressure of the can body 6*c* resulting from a temperature drop. The bag-shaped member 45 still remains in a sealed state, and the internal pressure of both the can body and the bag-shaped member drops to about 1 atm. in a normal temperature state. Both contents 20 and 21 are kept isolated from each other.

Meanwhile, when the can 46 is in use as shown in FIG. 17(D), the can body 6*c* of the can 46 is opened by operating the opening section 6*a* prior to being heated, so that the upper space of the can body is open to the atmosphere. The bottom of the can body 6*c* is directly heated by flames discharged from the burner 10 by igniting the same. When the temperature of the liquid contents 20 rises due to the heating of this burner 10, the temperature of the bag-shaped member 45 similarly rises, whereby the gas sealed within the bag-shaped member 45 thermally inflates, and its internal pressure rises to about 1.3 atm. at a temperature of 90 degrees Centigrade. However, unlike the sterilizing heating of the can, the raised internal pressure of the can body 6*c* will not affect the bag-shaped member, and hence the bag-shaped member 45 inflates in accordance with a rise in the internal pressure thereof. When the bag-shaped member is heated to a temperature of about 90 degrees Centigrade, a part of the member comes into contact with the opening means 48 so that the bag-shaped member 45 made of a resilient material and having a large tension due to the inflation of the member can immediately rupture. As a result of this, the contents 21 are released from their sealed state, and they are mixed with the liquid contents 20.

Figure 18:
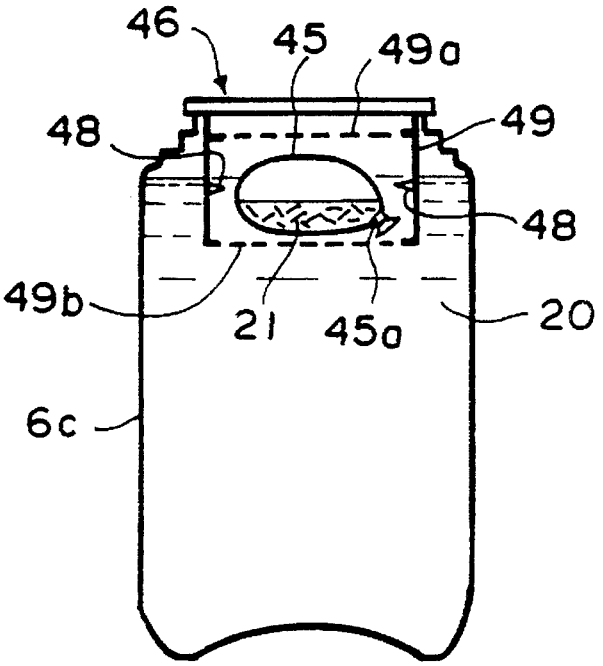
FIG. 18 is a cross-sectional view showing a modified example of the canned food or beverage according to the third embodiment of this invention.

FIG. 18 shows a modified example of a can to be heated according to this embodiment. As with the previous embodiment, a retaining member 49 for housing the bag-shaped member 45 is provided on the upper part of the can body 6*c*. The upper and lower surfaces of this retaining member 49 are made of meshed members 49*a* and 49*b*, and the needle-shaped means 48 are provided on the side surface of the retaining means. When the can body 6*c* is heated while open, the bag-shaped member 45 inflates in accordance with a temperature rise. When the bag-shaped member is ruptured upon contact with the opening means 48, and the bag-shaped member is released from its sealed state. The contents 21 such as tea leaves eventually try to come out of the bag-shaped member 45 and spread into the entire liquid contents 20. However, the presence of the lower meshed member 49*b* hinders the contents from spreading into the liquid contents, and the presence of the upper meshed member 49*a* obstructs the contents 21 such as tea leaves from flowing when the liquid contents 20 are poured out of the can body 6*c*.

<Fourth Embodiment>

Figure 19:
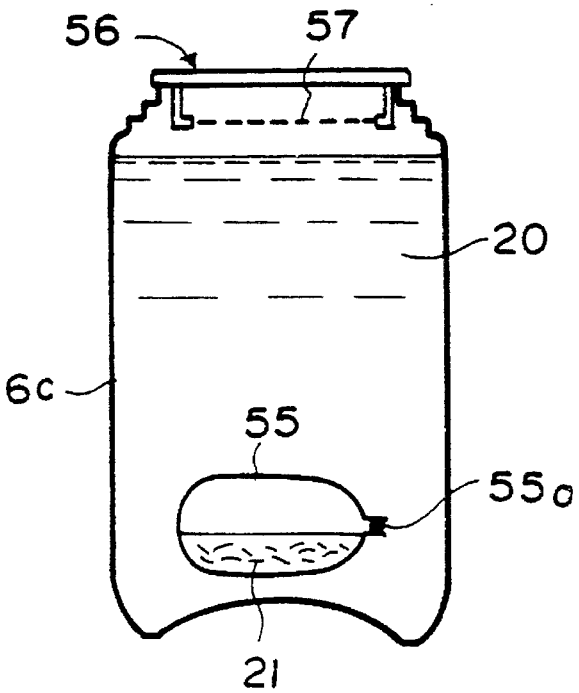
FIG. 19 is a cross-sectional view showing a canned food or beverage to be heated according to a fourth embodiment of this invention.

FIG. 19 shows another embodiment of a can to be heated similar to the previous embodiment.

The liquid contents together with a bag-shaped member 55 are sealed within the can body 6*c* of a can to be heated 56 according to this embodiment. The upper opening section of the can body 6*c* is covered with a meshed member 57. The same reference numerals are provided to designate the corresponding features of the previous embodiment.

The bag-shaped member 55 of this embodiment is made of an inelastic material such as heat-resisting plastic, and is formed into a bag. The contents 21 and a predetermined amount of gas (such as air) are contained in the bag-shaped member, and the opening section thereof is sealed by a sealed section 55*a* while the sealing of the bag-shaped member is ensured. The sealed section 55*a* is constructed so that it can open when the degree of inflation of the bag-shaped member 55 exceeds a predetermined level in accordance with the inflation of an internal gas when the can is heated to a predetermined temperature.

The operation of the can 56 is principally the same as the third embodiment, and the internal pressure of the can body 6*c* and the bag-shaped member 55 is about 1 atm. when the can remains in a preserved state. The sealed section 55*a* of the bag-shaped member 55 maintains a sealed state, and the contents 20 and 21 are isolated from each other. When the can is heated in a sterilizing process, a raised internal pressure of the can body 6*c* affects the bag-shaped member 55, whereby the sealed section 55*a* maintains a sealed state without an increase in the content volume of the bag-shaped member 55. When the can 56 is in use; namely, the can body 6*c* is heated while open, a gas sealed within the bag-shaped member 55 inflates due to heat in accordance with a rise in the temperature of the liquid contents 20. The sealed section 55*a* becomes open by a tension which affects the sealed section when the bag-shaped member is heated to a temperature of 90 degrees Centigrade or thereabouts, whereby the contents 21 are released from their sealed state, and they are mixed with the liquid contents 20. In this case, the contents 21 such as tea leaves come out of the bag-shaped member 55, and spread into the entire liquid contents 20. The presence of the foregoing meshed member 57 prevents the contents 21 from flowing when the liquid contents 20 are poured from the can body 6*c*.

The contents 21 (chiefly tea leaves) may be contained in an inner bag made of a meshed member inside the bag-shaped member 55. In this case, the meshed member 57 used in this embodiment may be rendered unnecessary. The meshed member becomes unnecessary depending on the contents. Also, in the previous embodiment, the contents 21 may be contained in the inner bag.

<Fifth Embodiment>

Figure 20:
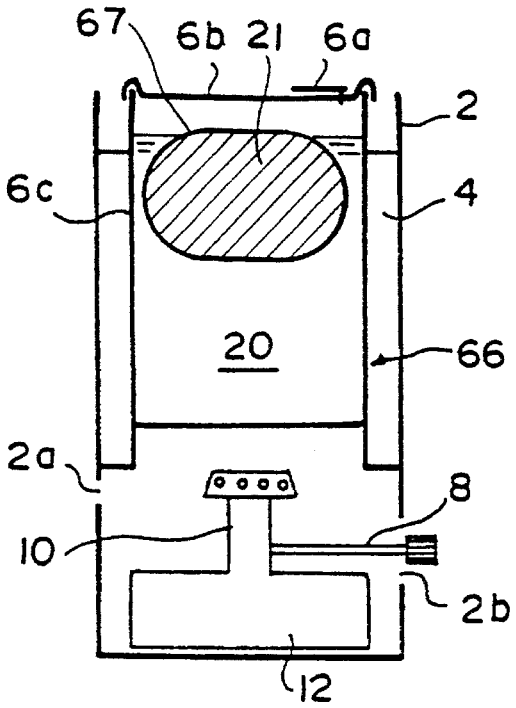
FIG. 20 is a schematic cross-sectional view showing a canned food or beverage having a burner which uses canned goods to be heated according to a fifth embodiment of this invention.

FIG. 20 is a schematic cross-sectional view showing a can with a burner which uses canned goods to be heated according to this embodiment.

The principal structure of the can is the same as the first embodiment. The can is provided with a cylindrical outer case 2, a can to be heated 66 fixedly housed at an upper part within this outer case 2, a burner 10 equipped with an ignition means 8, and a fuel tank 12. In the can to be heated 66, liquid contents 20 (for instance, water) and solid contents 21 (for example, seasoned noodles) are contained in a heat-resisting can body 6*c* while they are isolated from each other by means of a capsule-like partition member 67. This partition member 67 is made of material which is insoluble in water at a normal temperature but becomes soluble when heated above a predetermined temperature. This partition member is inserted into the can body 6*c* while the solid contents 21 are contained in the partition member. The can body is sealed while filled with the liquid contents 20 which are chiefly water. The partition member 67 is set to be dissolved when the temperature thereof becomes below the boiling point of the liquid contents 20 but also above a sterilizing temperature, for instance, 90 degrees Centigrade.

The operation of this embodiment will now be described. When it is at a normal temperature state and also a sterilizing temperature, the liquid contents 20 and the solid contents 21 within the can 66 are isolated from each other by means of the partition member 67 that is insoluble in water, they are preserved while these contents remain isolated from each other. When the can is in use, the burner 10 is ignited, and the bottom of the can body 6*c* is directly heated by flames discharged from the burner. When the temperature of the liquid contents 20 rises above a predetermined level by the heating of the burner 10, the partition member 67 becomes soluble in water, and hence the partition becomes dissolved. Thereby, the internal solid contents 21 come into contact with the liquid contents 20, and they are cooked by heating.

Figure 21:
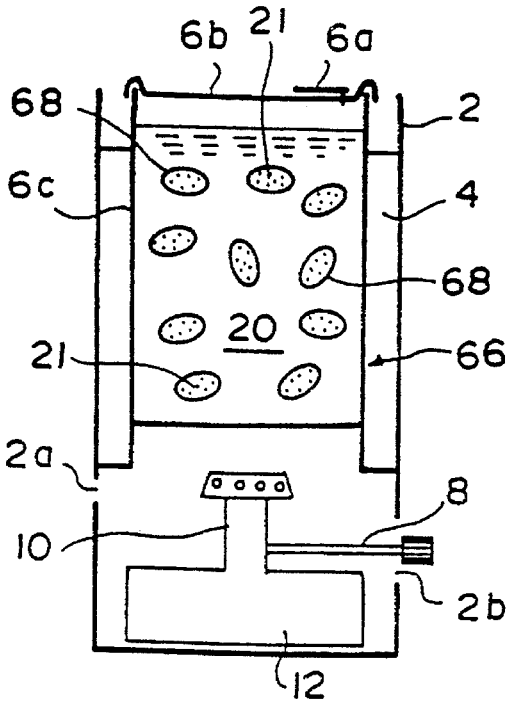
FIGS. 21 through 24 are schematic cross-sectional views showing a canned food or beverage having a burner which uses canned goods to be heated according to a fifth embodiment of this invention.

FIGS. 21 to 24 show modified examples of the partition member according to this embodiment. A partition member 68 shown in FIG. 21 is formed into a plurality of capsules, and contents 21 like powder or particles (for example, instant coffee and soup stock or the like) are contained in these capsules. These contents are isolated from the surrounding liquid contents 20 by means of the partition member. These partition members 68 are insoluble in water at a normal temperature similar to the previous embodiment, but become soluble when the temperature of the can rises when heated, so that the partition members are dissolved and hence the partition disappears. Thereby, both contents 20 and 21 are mixed together.

Figure 22:
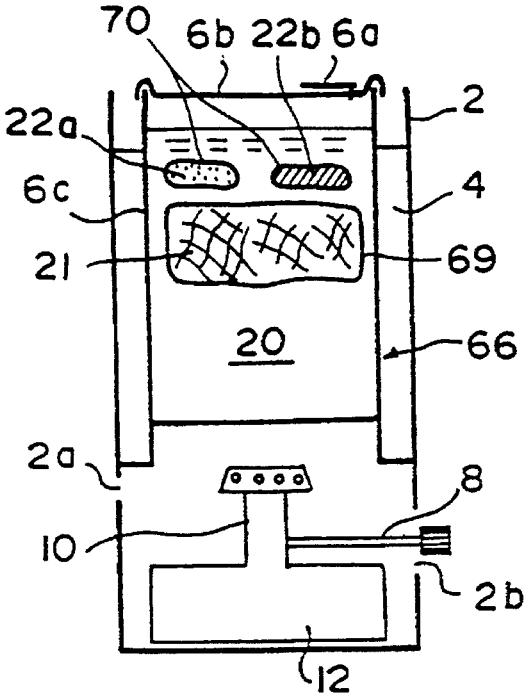

Partition members 69 and 70 shown in FIG. 22 are examples in which contents are divided into a plurality of types to a greater extent. Solid contents 21 (for examples, noodles) are encapsulated in the capsule-shaped partition member 69 which is relatively larger when compared with the liquid contents 20, whilst other contents 22*a* and 22*b* (for example, soup stock and seasoning or the like) are encapsulated in small-sized capsule-shaped partition members 70 independently from the solid contents. When the temperature of the can rises, the partition members 69 and 70 are dissolved, and hence a partition disappears. The contents 20, 21, 22*a* and 22*b* are mixed together, and then cooked by heating.

Figure 23:
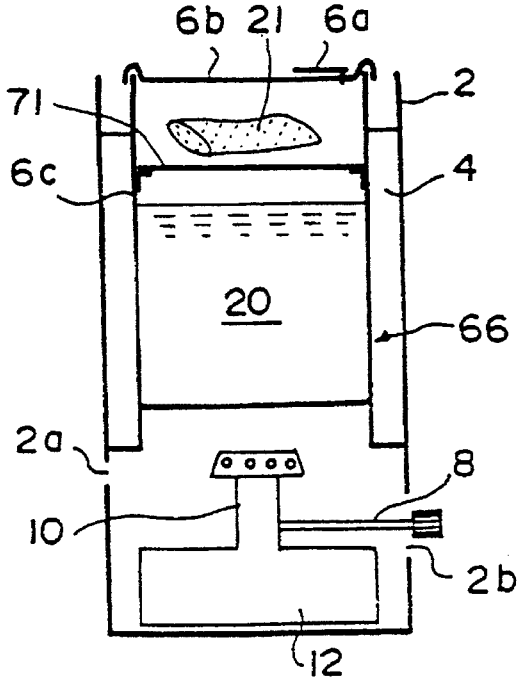

A partition member 71 shown in FIG. 23 is an example in which the inside of the can body 6*c* is divided into two compartments. Liquid contents 20 are stored in the lower compartment of the can body 6*c*. The partition member 71 like a membrane is fixedly adhered to the surrounding wall of the can body 6*c* above the liquid contents, thereby isolating the upper spacing from the lower spacing. Contents 21 to be extracted such as a tea bag are stored in the upper compartment above the partition member 71. A resin film having a low fusing point, for example, is used as the partition member 71. The partition member is constituted in such a manner that the temperature thereof is below the fusing point at a normal temperature and a sterilizing temperature, but exceeds the fusing point when the temperature of the can rises (when the can is in use), and hence the partition members are dissolved and a partition disappears. This partition member 71 is set to be dissolved at a temperature which is below the fusing point of the liquid contents 20 and also above a sterilizing temperature, for example, 90 degrees Centigrade.

According to this embodiment, the membrane-like partition member 71 remains not dissolved at the normal and sterilizing temperatures, so that the contents are sealed within the partition. When the temperature of the can rises, the partition member 71 is dissolved, and hence a partition disappears. As a result of this, the contents 21 such as a tea bag fall into, and are immersed in, a liquid content section 5*a* the temperature of which is rising.

Figure 24:
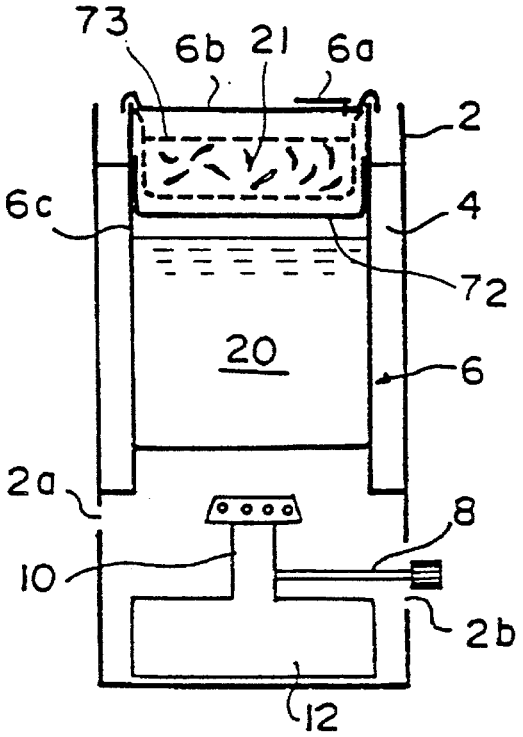

A partition member 72 shown in FIG. 24 is an example in which the inside of the can body 6*c* is similarly divided into two compartments. Different contents are stored in the upper compartment. The liquid contents 20 are contained in the lower compartment of the can body 6*c*. The partition member 72 like a membrane is fixedly adhered to the surrounding wall of the can body 6*c* above the liquid contents, thereby isolating the upper compartment from the lower compartment. Contents to be extracted such as tea leaves are contained in a meshed container 73 within a spacing above the partition member 72.

According to this embodiment, the membrane-like partition member 72 remains not dissolved at the normal and sterilizing temperatures, so that the contents are sealed in the compartment. When the temperature of the can rises, the partition member 72 is dissolved, and hence a partition disappears. The meshed container 73 eventually falls into, and is immersed in, the liquid contents 20 the temperature of which is rising. Alternatively, the liquid contents 20 are caused to flow through the contents 21 in the meshed container 73 when the liquid contents 20 are poured.

<Sixth Embodiment>

Figure 25:
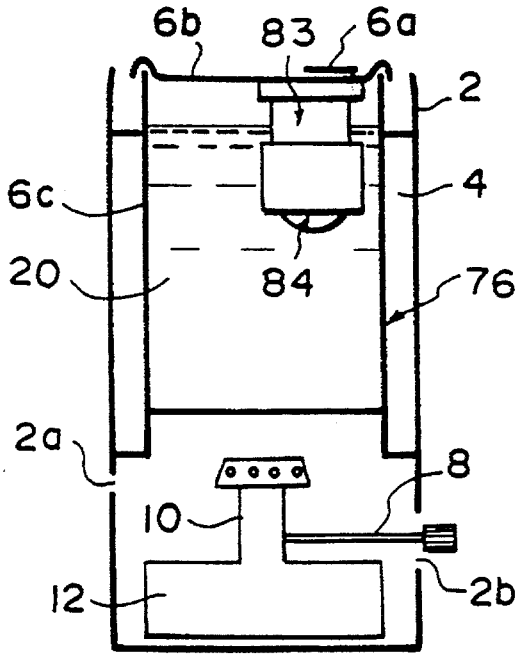
FIG. 25 is a schematic cross-sectional view showing a canned food or beverage having a burner which uses canned goods to be heated according to a sixth embodiment of this invention.

FIG. 25 is a schematic cross-sectional view showing a can with a burner which uses a can to be heated according to this embodiment.

The principal structure of the can with a burner is the same as the first embodiment, and the can is provided with a cylindrical outer case 2, a can to be heated 76 fixedly housed at an upper portion within this outer case 2, a burner 10 equipped with an ignition means 8 and a fuel tank 12.

Figure 26:
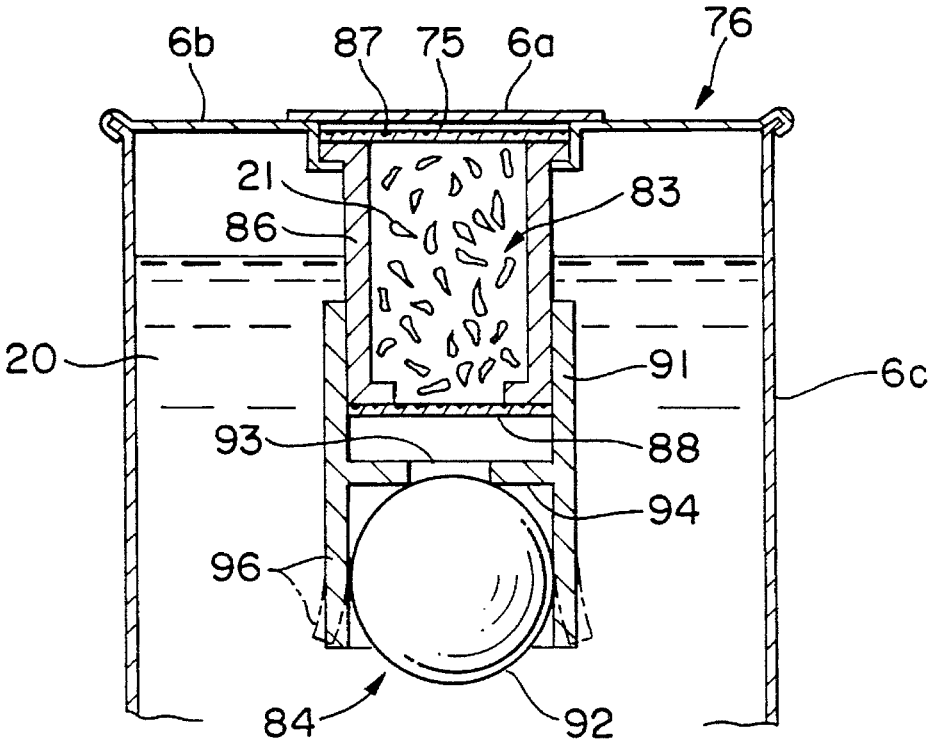
FIG. 26 is a cross-sectional view showing a detailed structure of chief elements of the canned food or beverage shown in FIG. 25.

In the can 76, liquid contents 20 such as water are sealed within a heat-resisting can body 6c. As shown in FIG. 26, a container section 83 for storing contents 21 such as tea leaves is formed so that it can be connected to an outlet port 75. A valve mechanism 84 which opens the container section 83 when the can is heated is disposed below the container section 83.

Specifically, a cylinder member 86 the inside of which acts as the container section 83 is formed into a cylindrical shape. The upper end engaging section of the cylinder member 86 is joined to a recess formed in the vicinity of the outlet port 75 of a lid 6*b* in a sealed manner. The upper opening of the container section 83, that is, the cylinder member 86 is closed by a meshed member 87. Likewise, the lower opening end of the cylinder member is closed by a meshed member 88, and the contents 21 such as tea leaves are contained in the container section.

The valve mechanism 84 is made up of a casing member 91 and a ball 92. The upper end of the casing member 91 is fitted around the outer peripheral of the lower end part of the cylinder member 86 in a sealed manner. A stopper 94 is formed inside the middle of the casing member, and a communicating hole 93 is formed at the center of the stopper. A holding section 96 cylindrically extends downwards from the lower end of the casing member. The ball 92 is fitted into the holding section 96 of the casing member 91 so that the communicating hole 93 can be blocked up from its bottom end.

The cross section of the holding section 96 is formed into, for example, a crimp, and the holding section is deformed depending on a temperature. At a normal temperature and a sterilizing process, the holding section is closed to the inside as designated by a solid line, so that the ball 92 is held by the holding section. The communicating hole 93 of the stopper 94 is kept closed by the ball 92. When the can is heated above a predetermined temperature, and the temperature thereof rises, the holding section 96 is deformed outwardly as designated by a dotted line. As a result of this, the force for holding the ball 92 is weakened, and the ball 92 drops, so that the communicating hole 93 is open. The temperature at which the communicating hole 93 is open by means of this valve mechanism 84 is set below the boiling point of the liquid contents 20 and above a sterilizing temperature, for example, 90 degrees Centigrade.

Here, a flexible material may be disposed on a sealed surface of the communicating hole 93 in order to increase the sealing characteristics of the ball 92 with respect to the stopper 94.

The operation of this embodiment will be described. At a normal temperature state and a sterilizing state, the valve mechanism 84 remains in a closed state, and hence the contents 21 within the container section 83 are preserved without contact with the liquid contents 20. When the can is used for drink, the burner 10 is ignited, and the bottom of the can body 6*c* is directly heated by flames discharged from the burner. When the temperature of the liquid contents 20 rises above a predetermined level by the heating of this burner 10, the ball 92 of the valve mechanism 84 drops, so that the communicating hole 93 is open. The heated liquid contents 20, namely boiling water, flows through the inside of the container section 83. When the boiling water comes into contact with the contents 21, that is, tea leaves, ingredients of the tea are extracted, and a resulting infusion is poured out from the outlet port 75 for drink as green tea by inclining the can 6.

In this embodiment, the meshed member 88 is disposed on the lower opening end of the container section 83 so that the contents 21 can be prevented From dropping and spreading into the liquid contents 20. However, when the valve mechanism 84 is open, it may be arranged that the contents 21 drop and spread into the liquid contents 20 so that ingredients of the contents can be extracted without the use of the meshed member 88.

Figure 27:
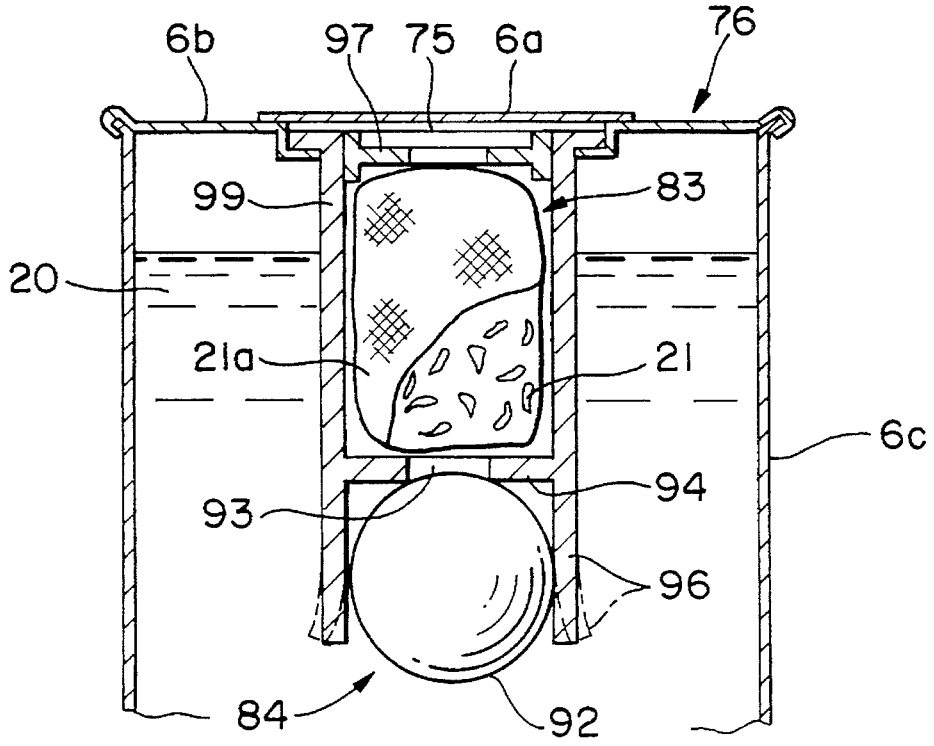
FIG. 27 is a cross-sectional view of chief elements of a canned food or beverage to be heated which shows a modified example of the sixth embodiment.

FIG. 27 shows a modified example of this embodiment. The powder or particle contents 21 are directly stored in the container 83 made of the cylindrical member 86 in the embodiment shown in FIG. 26. However, in this example, the contents are contained in a water-permeable bag 21*a* such as a tea bag, and the cylindrical member of the container section 83 is integrated with the casing member of the valve mechanism 84.

Practically, a cylindrical member 99 which is in a substantial hollow shape is connected to the outlet port 75 of the heat-resisting can body 6*c* of a can to be heated 76. In the middle of this cylindrical member 99, a stopper 94 having a communicating hole 93 which is blocked with a ball 92 is formed. The container 83 is formed above this stopper 94, and a tea bag in which contents 21 such as tea leaves are contained in the bag 21*a* is inserted into this container section 83. A presser member 97 is disposed on the upper opening end of the container section 83. To the contrary, a part of the cylindrical member 99 which extends downwards past the stopper 94 is formed into a holding section 96. A ball 92 for blocking the communicating hole 93 is fitted into this holding section. At a raised temperature, the holding section 96 becomes deformed, and the ball 92 drops to open the communicating hole 93.

In each of the foregoing embodiments, the structure using the ball 92 is illustrated as the valve mechanism 84 for opening the communicating hole 83 at a raised temperature. However, other mechanisms may be appropriately employed. In other words, for example, the stopper 94 of the previous embodiment may be formed into a membrane with a film member, and the liquid contents 20 and the contents 21 of the container section 83 such as tea leaves may be isolated from each other with this membrane member. A deformable member, which is deformed when the temperature of the can rises in the same manner as the holding section 96 in the previous example, may be connected to this membrane member. The valve mechanism may be arranged in such a manner that the deformation of this deformable member causes the membrane member to be broken so that the communicating hole 93 can be opened.

The communicating hole 93 of the stopper 94 may be constituted in such a manner that the communicating hole can be opened and closed by means of a valve member using a bi-metal. That is to say, a valve body which blocks the communicating hole 93 is provided on the end of the bi-metal. At a normal temperature, the opening of the hole is closed under a thrusting force of the bi-metal, whilst at a raised temperature the bi-metal is deformed so that the communicating hole 93 can be opened.

The valve mechanism may be constituted utilizing a ferrite member. The ferrite member may possess a magnetic force and close the communicating hole 93 at a normal temperature, but may lose its magnetic force at a raised temperature, thereby opening the communicating hole 93.

The sealing of the outlet port 75 may be arranged in such a manner that it is closed by removably attaching aluminum foil to the opening section of the lid 6*b* when the can is preserved, but the outlet port 75 is open by peeling off the aluminum foil when the can is heated, and hence the liquid contents 20 are poured.

What is claimed is:

1. Canned goods to be heated comprising a heat-resistant can body having an openable section in an upper part thereof, a supply of liquid contained in the can body, and a pressure-responsive container within the can body containing material to be mixed with the liquid, the pressure-responsive container comprising two sections having adjacent surfaces which are sealingly engaged and are relatively movable with respect to each other while maintaining their sealing engagement when the openable section of the can body is closed to maintain isolation of the material therein from the liquid in the can body, the pressure-responsive container being arranged so that the relatively-movable surfaces of the sections separate in response to an increase in internal pressure inside the container to permit mixing of the liquid in the can body with the material in the container in response to heating of the container above a predetermined temperature while the openable section of the can body is opened.

2. Canned goods to be heated according to claim 1 wherein the pressure-responsive container contains gas which increases in pressure upon heating to open the container in the absence of counteracting external pressure.

3. Canned goods to be heated according to claim 1 wherein the pressure-responsive container comprises a cylindrical casing and a lid-shaped closing member in which the cylindrical casing is slidably received and a sealing member interposed between adjacent sliding surfaces of the cylindrical member and the lid-shaped closing member.

4. Canned goods to be heated according to claim 1 including a mesh member within the container to retain the material contained therein when it is mixed with the liquid.

5. Canned goods to be heated according to claim 1 including a mesh member within the can body to retain material from the container within the can body when the liquid is removed through the openable section thereof.

* * * * *

UNITED STATES PATENT AND TRADEMARK OFFICE

CERTIFICATE OF CORRECTION

PATENT NO. : 5,456,929

DATED : October 10, 1995

INVENTOR(S) : Hideo Mifune, et al.

It is certified that error appears in the above-indentified patent and that said Letters Patent is hereby corrected as shown below:

Cover Page: Item 56 - References Cited - U.S. PATENT DOCUMENTS [Form PTO-892 attached to Notice of Allowability] add the following:

--2,753,990 7/1956 Chalfin et al. .....206/221

4,886,674 12/1989 Seward et al. .....426/77x--.

Column 17, line 45 "From" should read -- from --.

Signed and Sealed this

Thirteenth Day of February, 1996

Bruce Lehman

BRUCE LEHMAN

*Commissioner of Patents and Trademarks*

*Attest:*

*Attesting Officer*